US006640467B1

(12) United States Patent
Krull

(10) Patent No.: US 6,640,467 B1
(45) **Date of Patent: *Nov. 4, 2003**

(54) SHOE ACCESSORY METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 0 days.

This patent is subject to a terminal disclaimer.

(21) Appl. No.: 10/190,146

(22) Filed: Jul. 2, 2002

Related U.S. Application Data

(63) Continuation of application No. 09/287,838, filed on Apr. 7, 1999, now Pat. No. 6,412,197, which is a continuation-in-part of application No. 08/896,810, filed on Jul. 19, 1997, now abandoned.

(51) Int. Cl.[7] ..... A43B 23/00

(52) U.S. Cl. ..... 36/136; 36/112; 24/712.2

(58) Field of Search ..... 36/136, 112; 24/712.2, 24/712.3; 2/246, 245; D2/946, 969–976, 898, 899, 900

(56) References Cited

U.S. PATENT DOCUMENTS

D191,575 S * 10/1961 Pool
6,412,197 B1 * 7/2002 Krull ..... 36/136

* cited by examiner

*Primary Examiner*—Ted Kavanaugh

(57) ABSTRACT

A figurine is mounted on a shoe. On a preferred embodiment, the figurine stands upright on top of the toe portion of the shoe; is selectively removable from the shoe; and is capable of standing upright on a floor surface when removed from the shoe.

24 Claims, 15 Drawing Sheets

Fig. 1
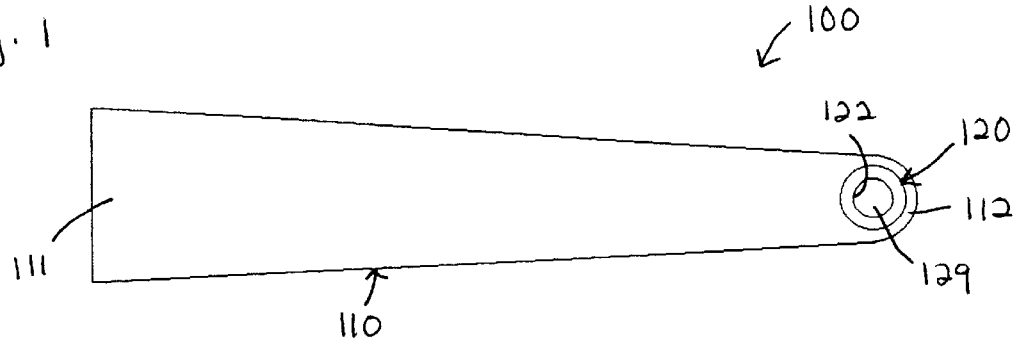
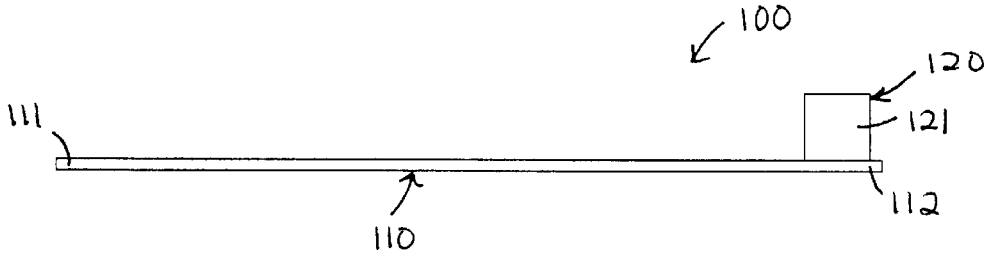
Fig. 2
Fig. 3
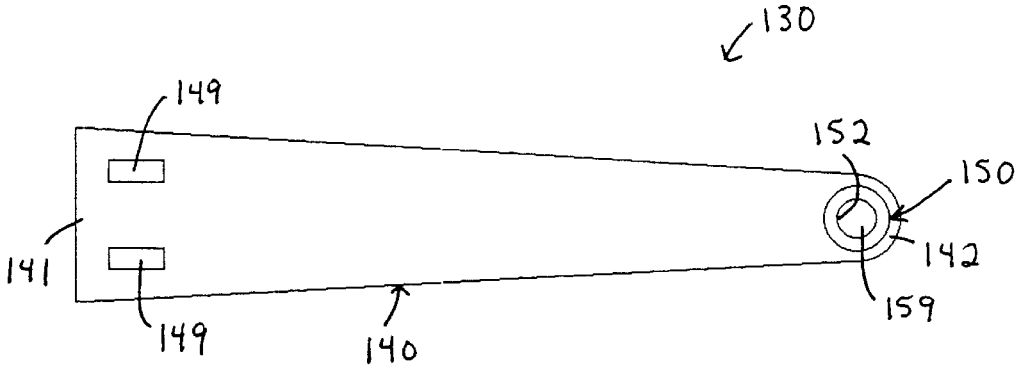
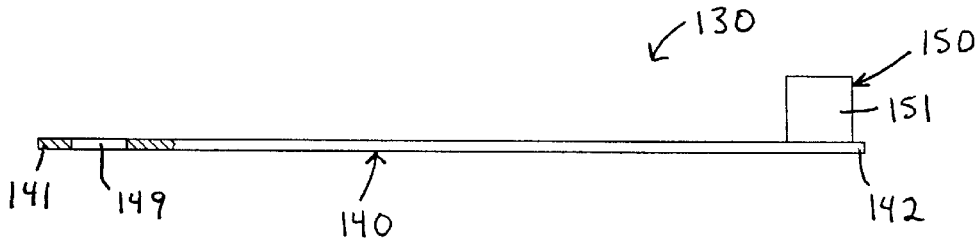
Fig. 4

Fig. 5
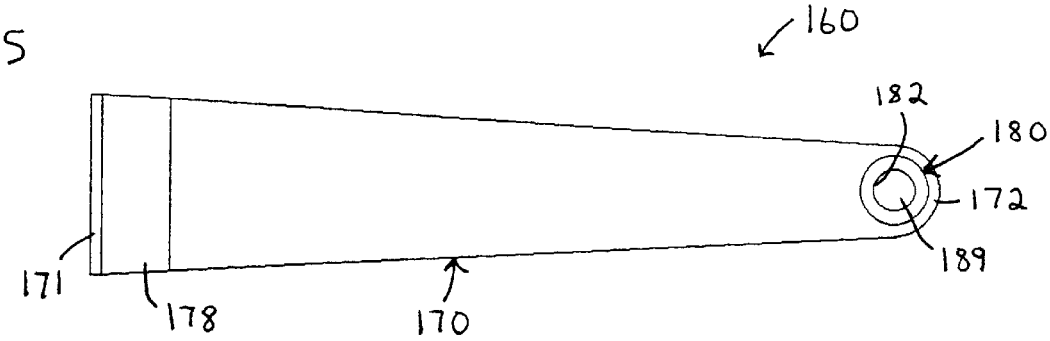
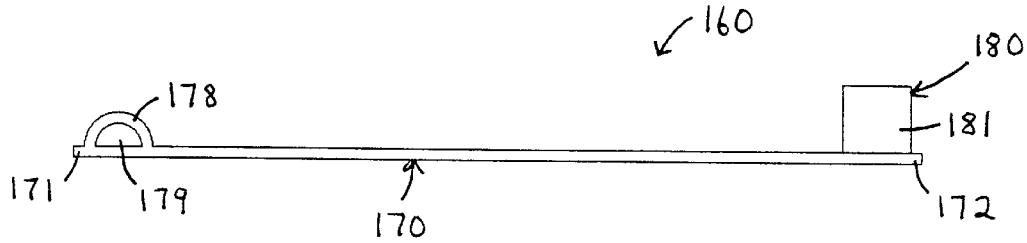
Fig. 6
Fig. 7
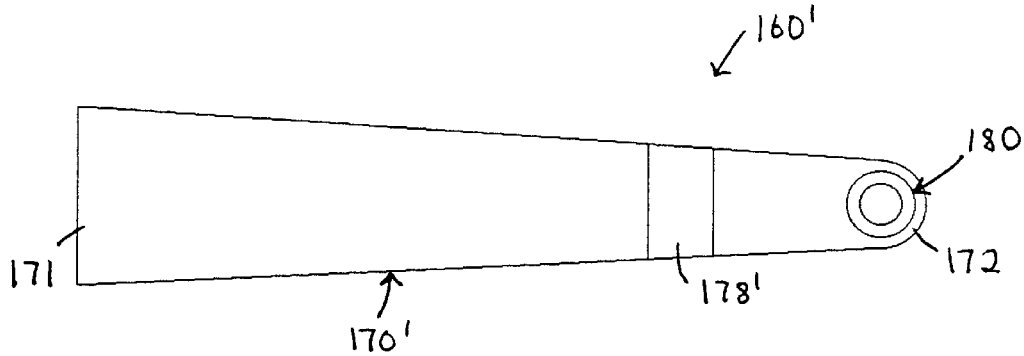
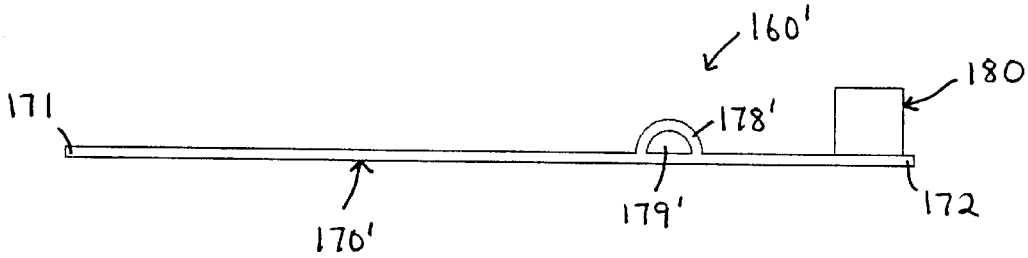
Fig. 8

Fig. 9
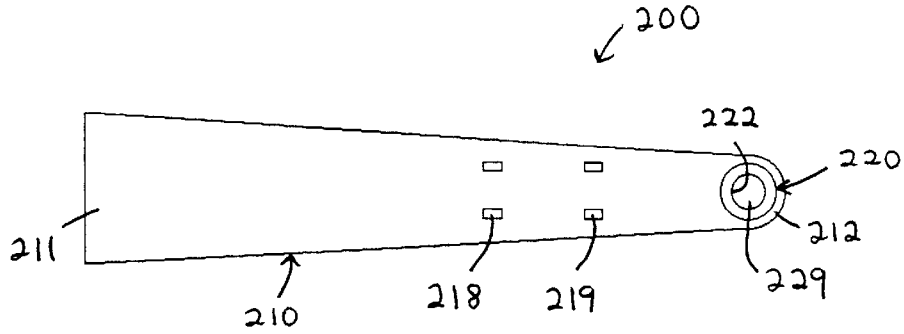
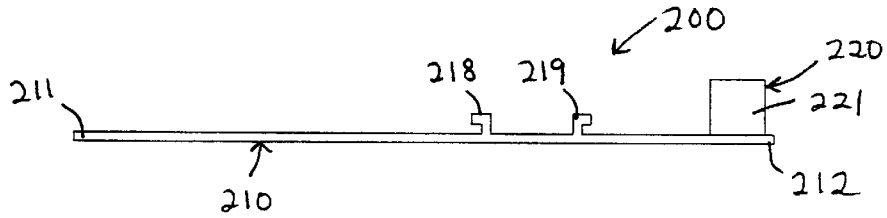
Fig. 10
Fig. 11
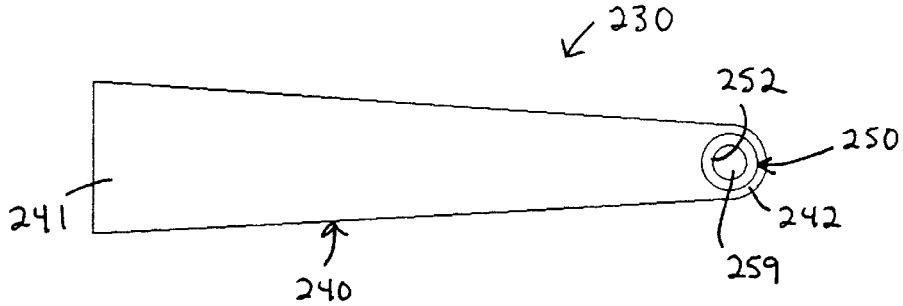
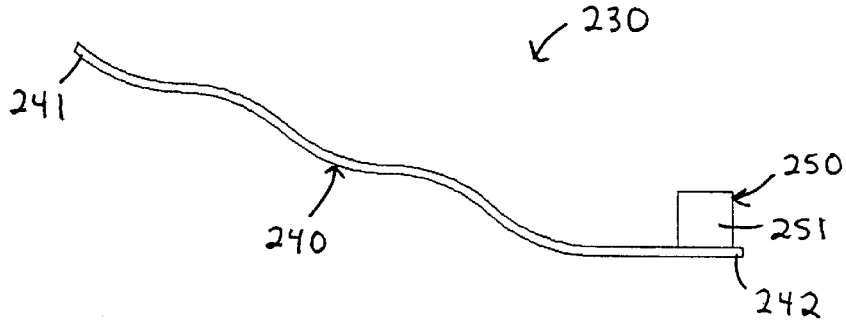
Fig. 12

Fig. 17
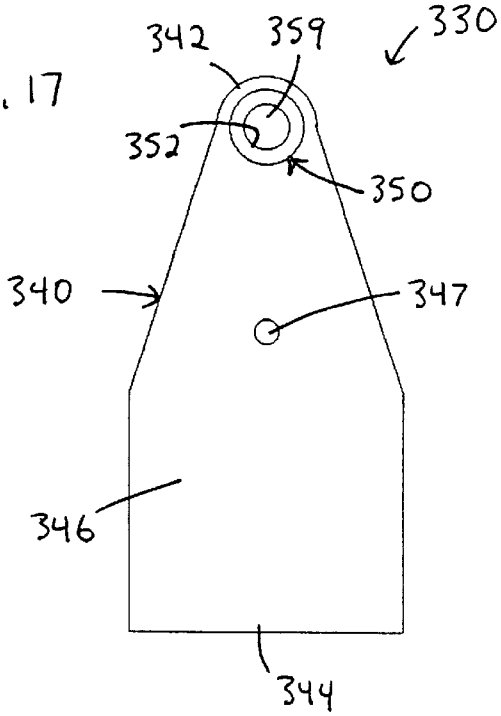
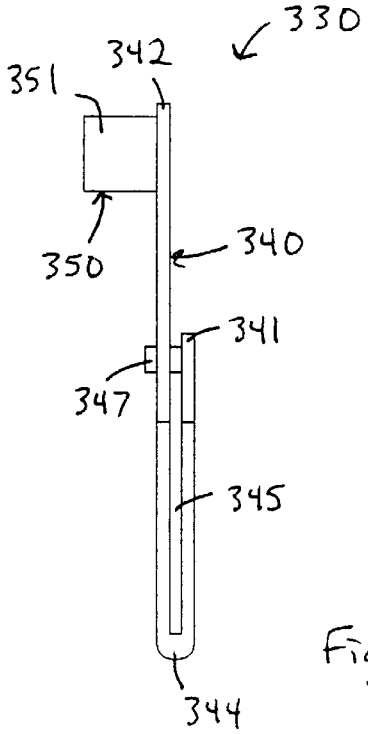
Fig. 18
Fig. 19
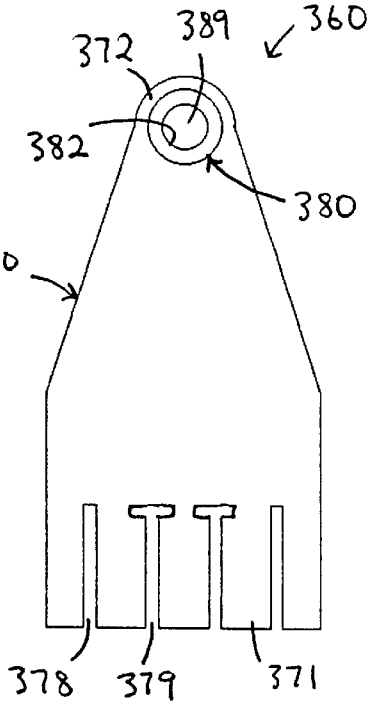
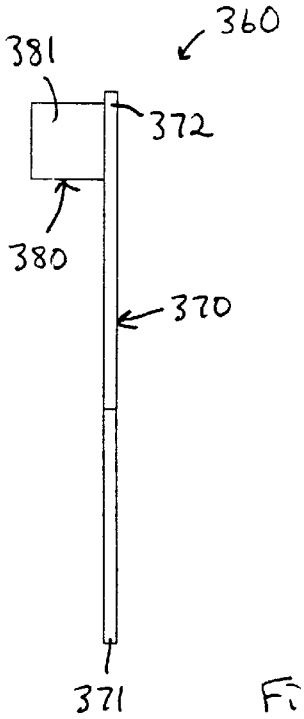
Fig. 20

Fig. 21
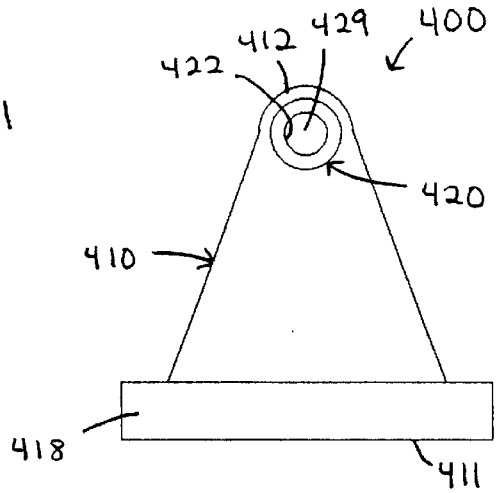
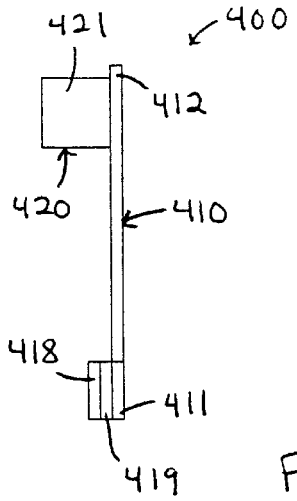
Fig. 22
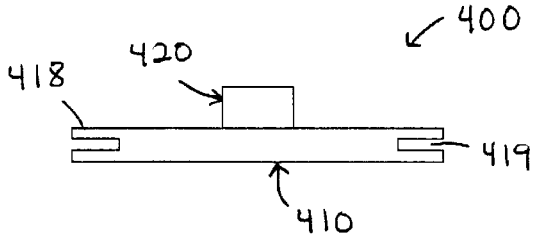
Fig. 23
Fig. 24
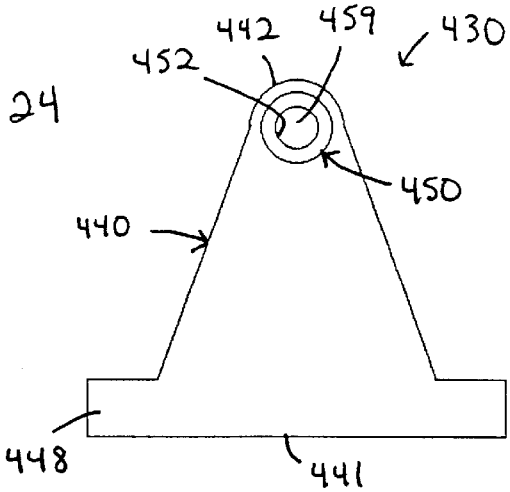
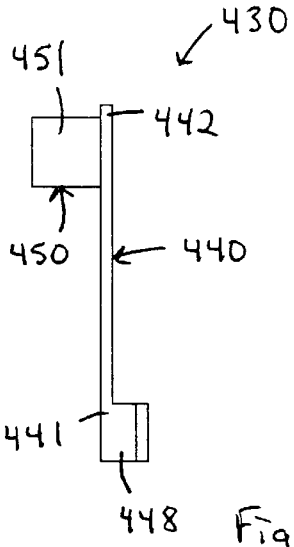
Fig. 25
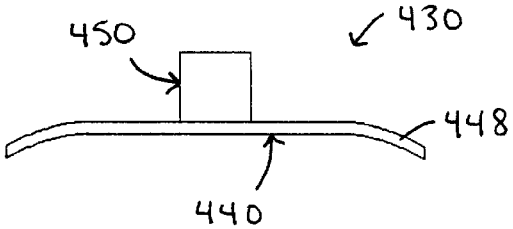
Fig. 26

Fig. 27
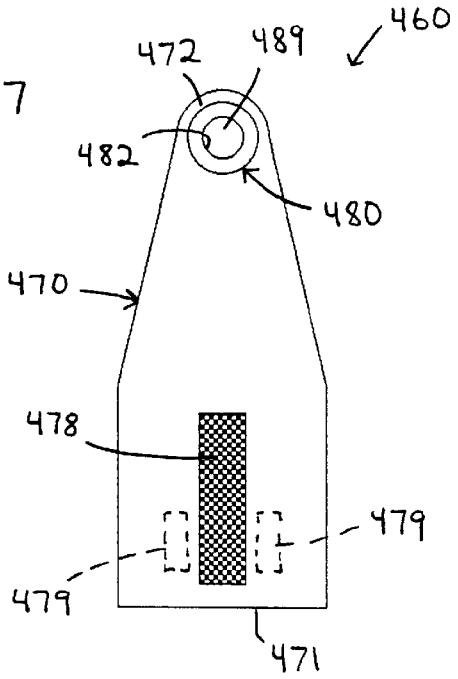
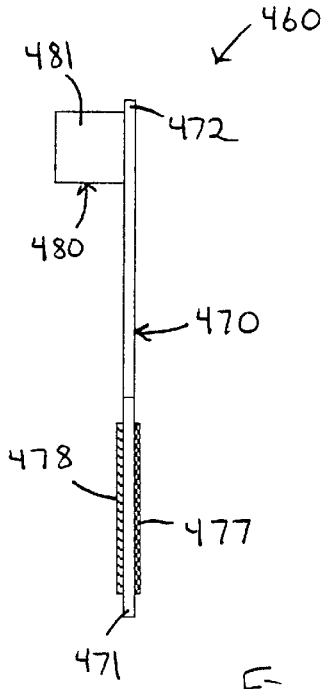
Fig. 28
Fig. 29
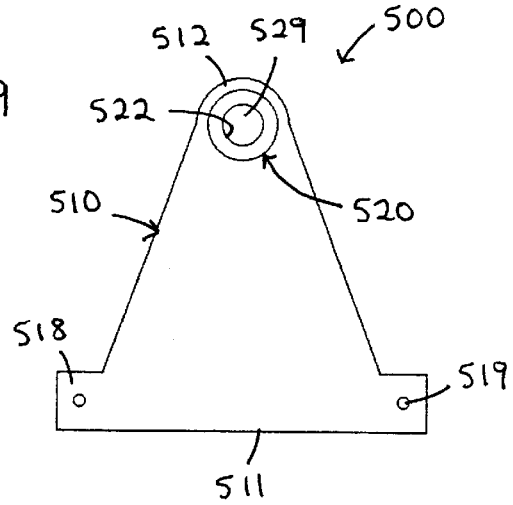
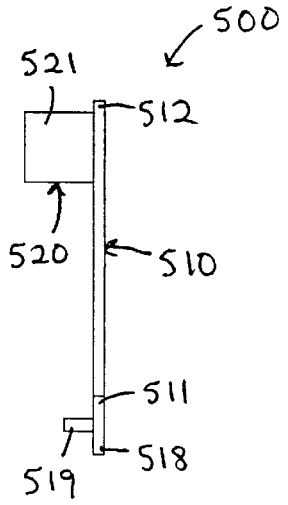
Fig. 30

Fig. 37
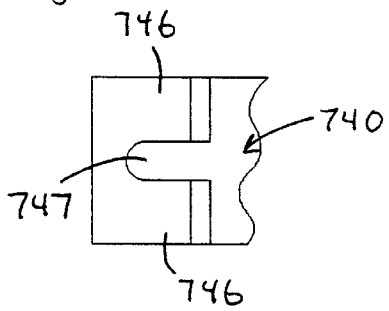
Fig. 39
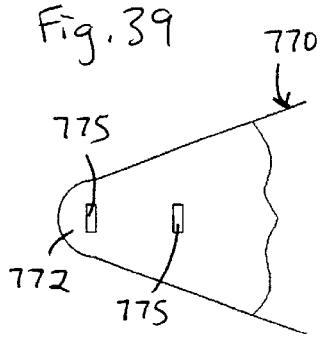
Fig. 38
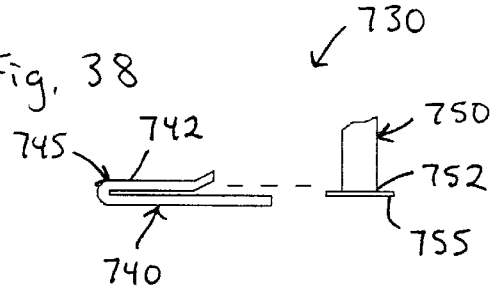
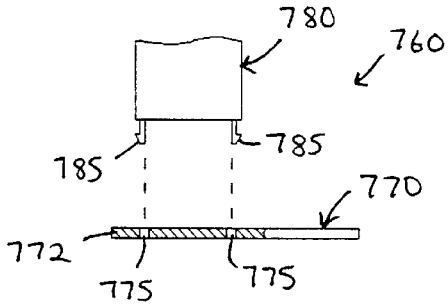
Fig. 40
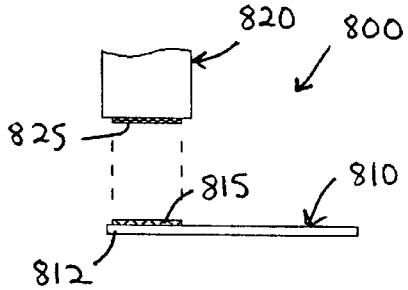
Fig. 41
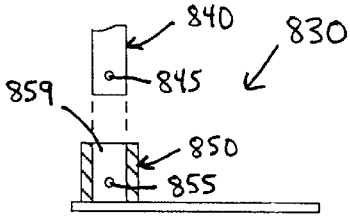
Fig. 42

Fig. 47
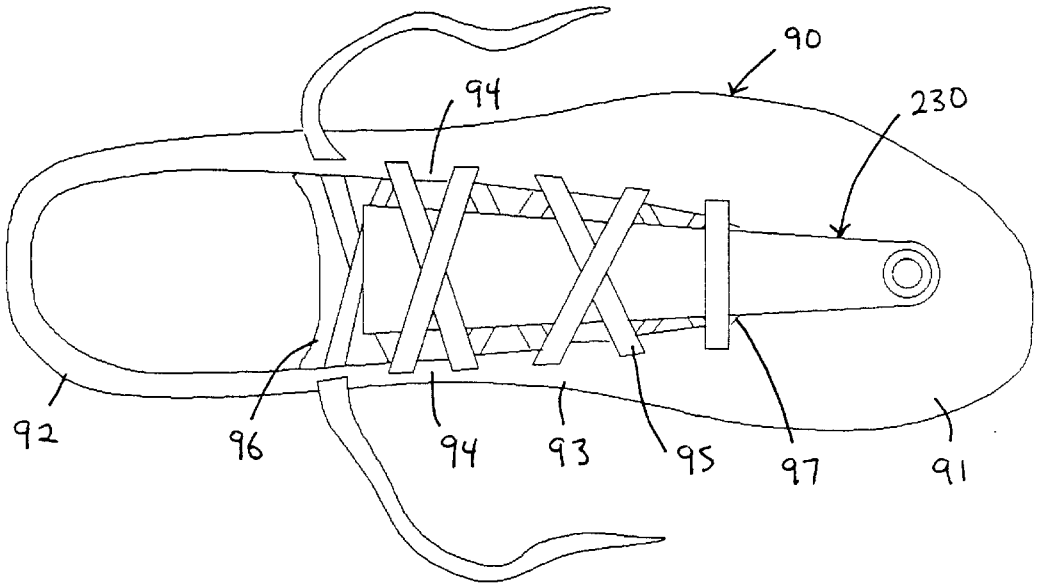
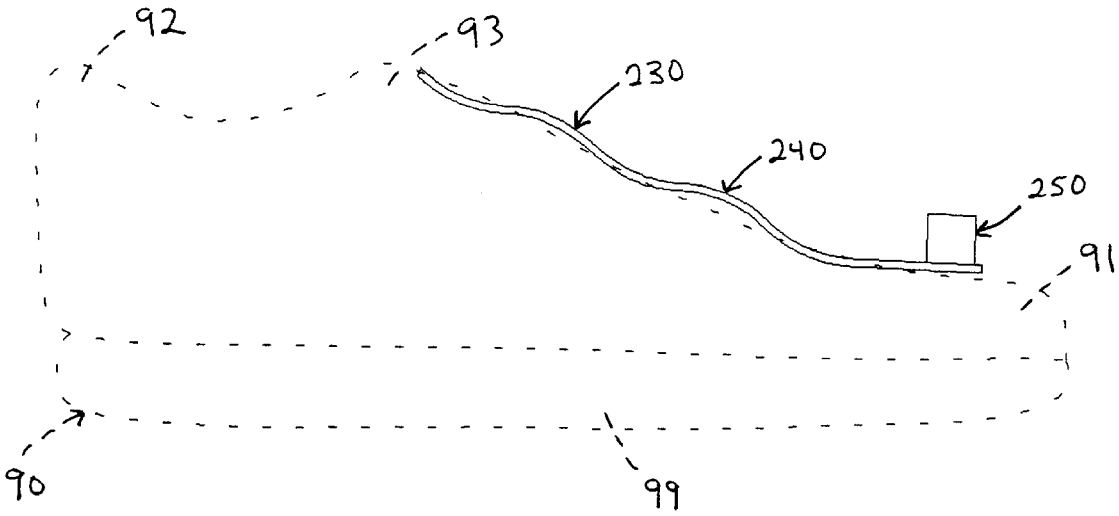
Fig. 48

Fig. 49
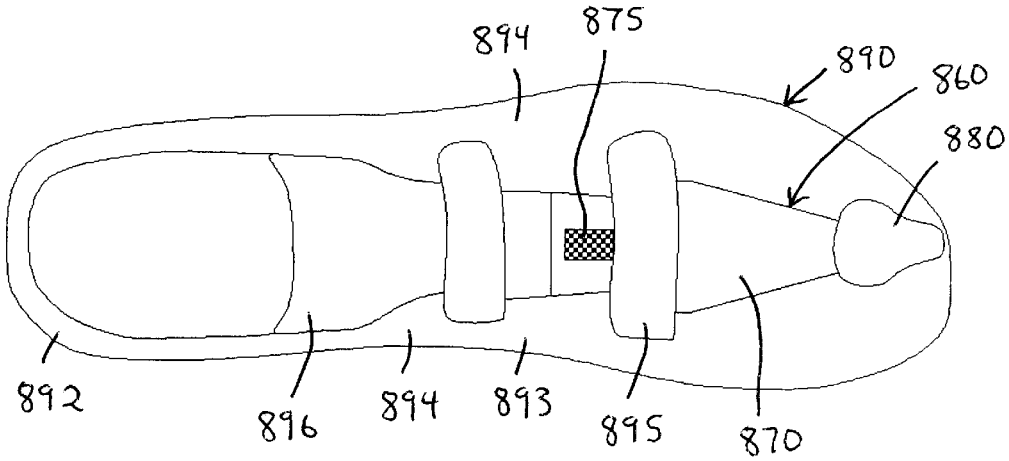
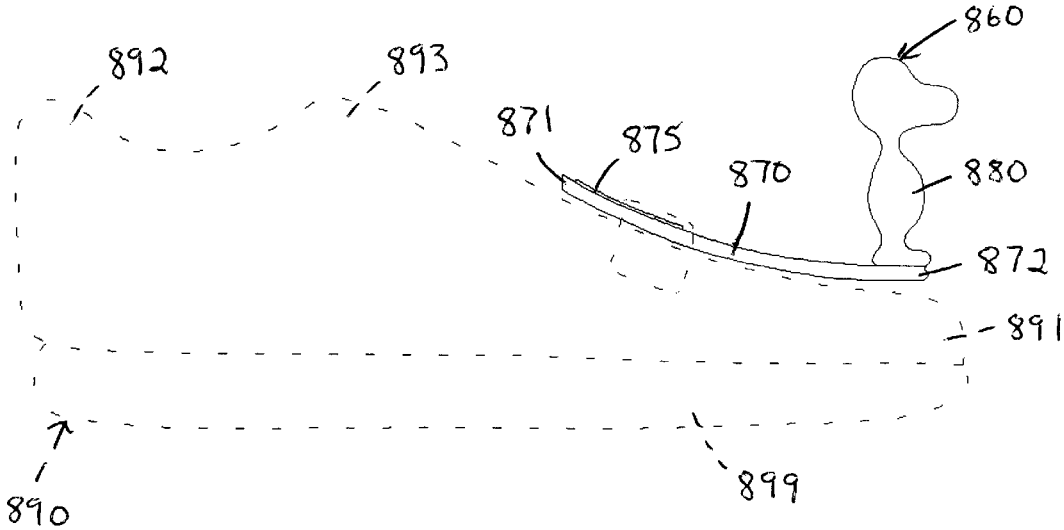
Fig. 50

Fig. 51
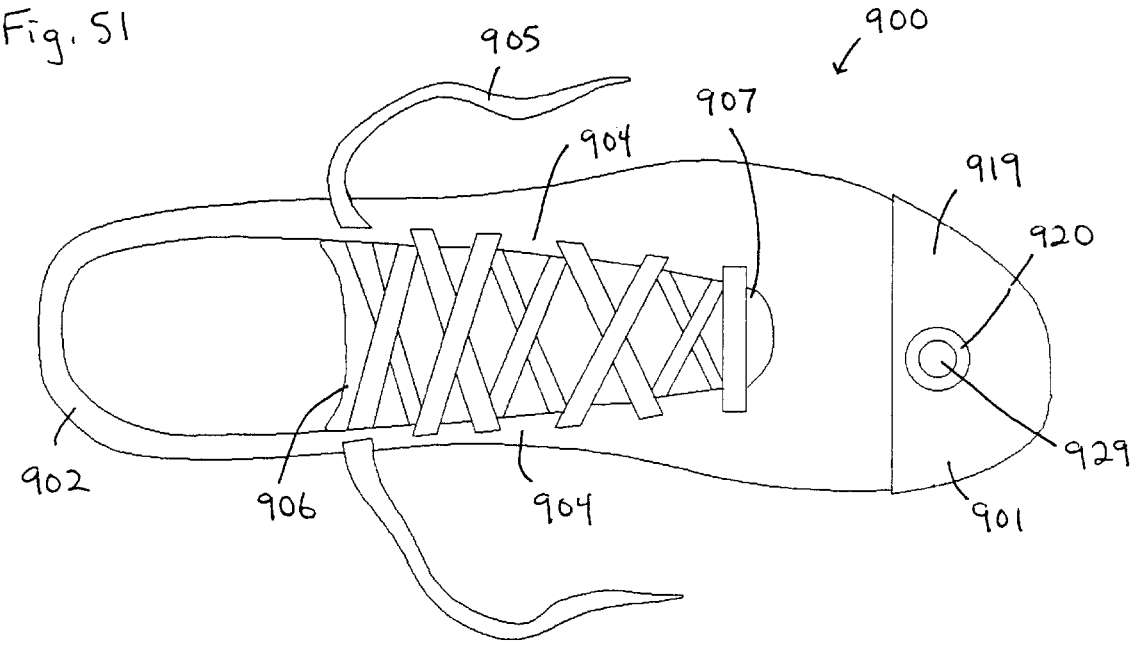
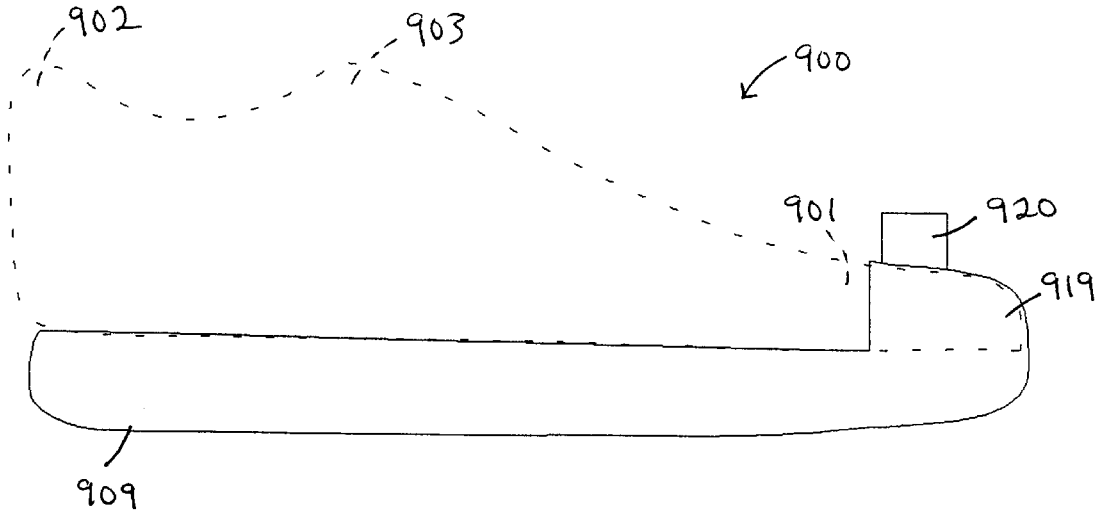
Fig. 52

Fig. 53
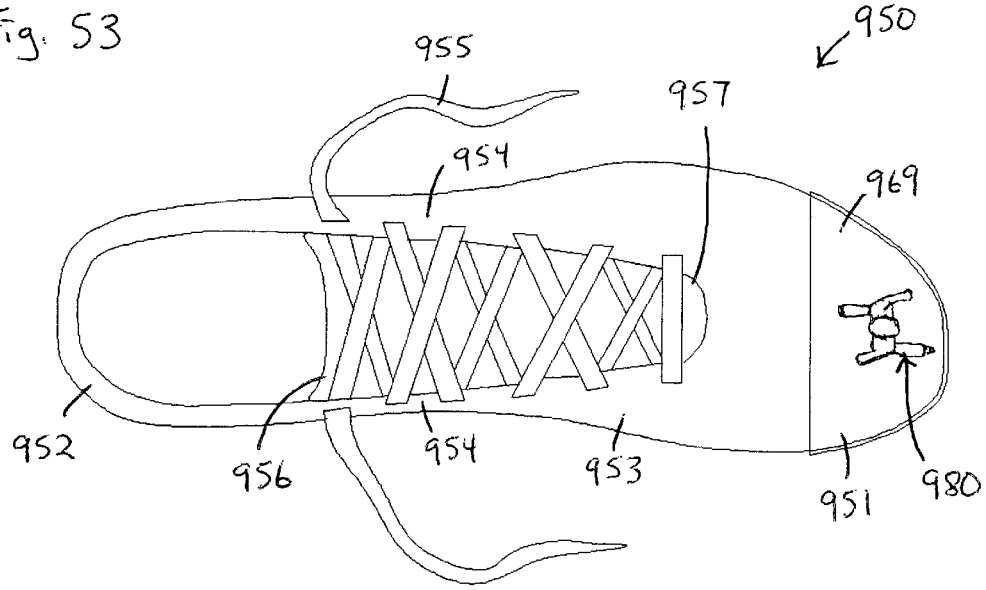
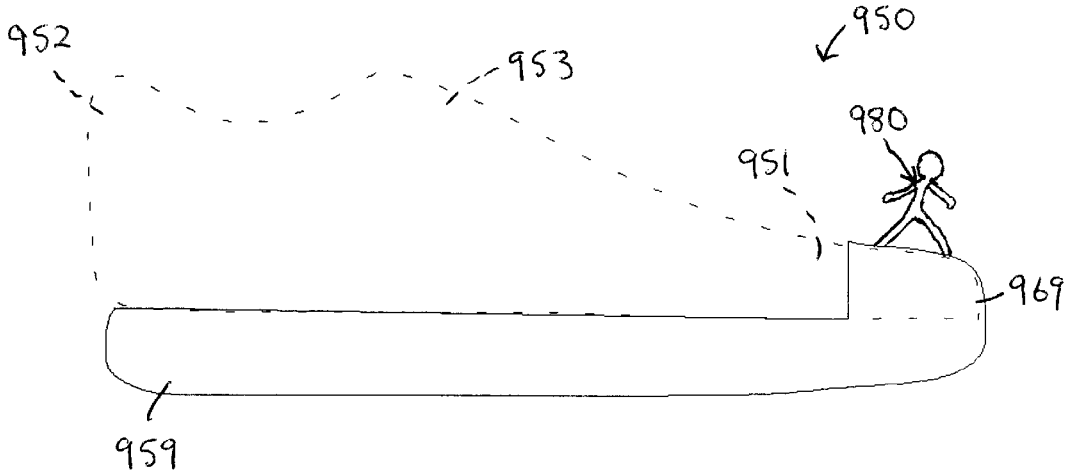
Fig. 54

SHOE ACCESSORY METHODS AND APPARATUS

CROSS-REFERENCE TO RELATED APPLICATIONS

This application is a continuation of U.S. patent application Ser. No. 09/287,838, filed on Apr. 7, 1999 (now U.S. Pat. No. 6,412,197), which in turn, is a continuation-in-part application of U.S. patent application Ser. No. 08/896,810, filed on Jul. 19, 1997 (now abandoned).

FIELD OF THE INVENTION

The present invention relates to shoes and in particular, to methods and apparatus for mounting figurines on shoes.

BACKGROUND OF THE INVENTION

Various prior art patents show amusing objects and/or ornaments connected to shoes. However, room for improvement continues to exist with respect to what types of objects are connected to the shoes and/or how such objects are connected to the shoes.

SUMMARY OF THE INVENTION

One aspect of the present invention is to mount a figurine on a shoe. On one embodiment, a member is releasably secured to the shoe, and the figurine is releasably secured to the member. On another embodiment, a member is releasably secured to the shoe, and a figurine is an integral portion of the member. On yet another embodiment, a shoe is adapted to receive a figurine, and the figurine is releasably secured directly to the shoe. Additional aspects and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views, FIG. 1 is a top view of a first device constructed according to the principles of the present invention;

FIG. 2 is a side view of the device of FIG. 1;

FIG. 3 is a top view of a second device constructed according to the principles of the present invention;

FIG. 4 is a partially sectioned side view of the device of FIG. 3;

FIG. 5 is a top view of a third device constructed according to the principles of the present invention;

FIG. 6 is a side view of the device of FIG. 5;

FIG. 7 is a top view of a fourth device constructed according to the principles of the present invention;

FIG. 8 is a side view of the device of FIG. 7;

FIG. 9 is a top view of a fifth device constructed according to the principles of the present invention;

FIG. 10 is a side view of the device of FIG. 9;

FIG. 11 is a top view of a sixth device constructed according to the principles of the present invention;

FIG. 12 is a side view of the device of FIG. 11;

FIG. 17 is a top view of a ninth device constructed according to the principles of the present invention;

FIG. 18 is a side view of the device of FIG. 17;

FIG. 19 is a top view of a tenth device constructed according to the principles of the present invention;

FIG. 20 is a side view of the device of FIG. 19;

FIG. 21 is a top view of an eleventh device constructed according to the principles of the present invention;

FIG. 22 is a side view of the device of FIG. 21;

FIG. 23 is an end view of the device of FIG. 21;

FIG. 24 is a top view of a twelfth device constructed according to the principles of the present invention;

FIG. 25 is a side view of the device of FIG. 24;

FIG. 26 is an end view of the device of FIG. 24;

FIG. 27 is a top view of a thirteenth device constructed according to the principles of the present invention;

FIG. 28 is a side view of the device of FIG. 27;

FIG. 29 is a top view of a fourteenth device constructed according to the principles of the present invention;

FIG. 30 is a side view of the device of FIG. 29;

FIG. 37 is a top view of a fifteenth device constructed according to the principles of the present invention;

FIG. 38 is an exploded side view of a seventh fastener combination constructed according to the principles of the present invention, including the device of FIG. 37;

FIG. 39 is a top view of a sixteenth device constructed according to the principles of the present invention;

FIG. 40 is an exploded, partially sectioned side view of an eighth fastener combination constructed according to the principles of the present invention, including the device of FIG. 39;

FIG. 41 is an exploded side view of a ninth fastener combination constructed according to the principles of the present invention;

FIG. 42 is an exploded, partially sectioned side view of a tenth fastener combination constructed according to the principles of the present invention;

FIG. 47 is a top view of the device of FIGS. 11–12 shown in relation to an otherwise conventional shoe;

FIG. 48 is a side view of the device and shoe combination of FIG. 47;

FIG. 49 is a top view of a seventeenth device constructed according to the principles of the present invention and shown in relation to an otherwise conventional shoe;

FIG. 50 is a side view of the device and shoe combination of FIG. 49;

FIG. 51 is a top view of a shoe constructed according to the principles of the present invention;

FIG. 52 is a side view of the shoe of FIG. 51;

FIG. 53 is a top view of another shoe constructed according to the principles of the present invention;

FIG. 54 is a side view of the shoe of FIG. 53;

DETAILED DESCRIPTION OF THE PREFERRED EMBODIMENT

Figure 13:
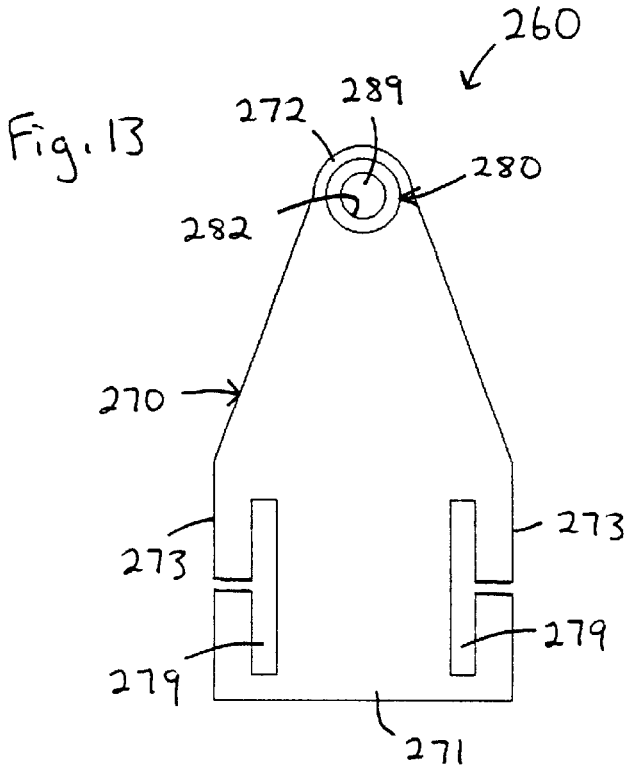
FIG. 13 is a top view of a seventh device constructed according to the principles of the present invention.

A first embodiment of the present invention is designated as 100 in FIGS. 1–2. The device 100 includes an elongate base or strip 110 extending from a first end or terminal portion 111 to a second end or terminal portion 112; and a connector or cylindrical shell 120 extending perpendicularly away from the strip 110 proximate the second end 112. As used herein, the term "elongate" shall mean having a width measured in a first direction, and having a length measured in a second, orthogonal direction, wherein the length is at least one and one-half times greater than the width. For purposes of determining the relative dimensions of the base 110 (or any other part shown herein) reference may be made to the appropriate drawing(s) attached hereto.

The strip 110 is adapted to be releasably connected to a shoe and to generally parallel the tongue of the shoe. Among other things, the strip 110 is about five mils thick, made of flexible plastic, and sized and configured to fit within the laces of a shoe. An advantage of this embodiment 100 is that the strip 110 may be inserted into engagement with the laces without loosening or otherwise disrupting the laces.

The shell 120 is adapted to releasably connect a figurine to the device 100. The shell 120 is defined between an outer cylindrical sidewall 121 and an inner cylindrical sidewall 122. The inner cylindrical sidewall 122 cooperates with the strip 110 to define an upwardly opening cylindrical compartment 129. A figurine may be releasably connected to the device 100 by inserting a portion of the object into the compartment 129 and/or over the outer sidewall 121. The shell 120 is oriented and positioned relative to the strip 110 to support the figurine in a generally upright position over the toe of the shoe.

The device 100 may also be described in terms of a first portion 110 which is sized and configured to be releasably connected to an intermediate portion of a shoe and/or to occupy a position beneath a closure on a shoe, and a second portion 120 which is sized and configured to extend forward, overlie a toe portion of the shoe, and support a figurine. The device 100 may similarly be described in terms of a first means 110 for connecting the device 100 to a shoe, and a second means 120 for connecting the figurine to the device 100.

A second embodiment of the present invention is designated as 130 in FIGS. 3–4. Like the first embodiment 100, the device 130 includes an elongate base 140 extending from a first end 141 to a second end 142; and a cylindrical shell 150 extending perpendicularly away from the base 140 proximate the second end 142.

The strip 140 is adapted to be releasably connected to a shoe and to generally parallel the tongue of the shoe. Among other things, the strip 140 is about five mils thick, made of flexible plastic, and sized and configured to fit within the laces of a shoe. Unlike the first embodiment 100, the device 130 has two slots or openings 149 extending through the strip 140 proximate the first end 141. A resulting advantage of this embodiment 130 is that the distal ends of a shoe lace may be inserted through the slots 149 and then tied into a knot to more securely connect the strip 140 to the shoe. In other words, the second embodiment 130 provides a discrete means 140 for securing the device 130 to a shoe.

The shell 150 is adapted to releasably connect a figurine to the device 130. The shell 150 is defined between an outer cylindrical sidewall 151 and an inner cylindrical sidewall 152. The inner cylindrical sidewall 152 cooperates with the strip 140 to define an upwardly opening cylindrical compartment 159. A figurine may be releasably connected to the device 130 by inserting a portion thereof into the compartment 159 and/or over the outer sidewall 151. The shell 150 is oriented and positioned relative to the strip 140 to support the figurine in a generally upright position over the toe of the shoe.

A third embodiment of the present invention is designated as 160 in FIGS. 5–6. Like the first embodiment 100, the device 160 includes an elongate strip or shoe connecting means 170 extending from a first end 171 to a second end 172; and a cylindrical shell or connecting means 180 extending perpendicularly away from the strip 170 proximate the second end 172.

The strip 170 is adapted to be releasably connected to a shoe and to generally parallel the tongue of the shoe. Among other things, the strip 170 is about five mils thick, made of flexible plastic, and sized and configured to fit within the laces of a shoe. Unlike the first embodiment 100, the device 160 has a semi-cylindrical wall 178 connected to the strip 170 proximate the first end 171. The wall 178 and the shell 180 are disposed on the same side of the strip 170, and the wall 178 has a longitudinal axis which extends perpendicular to both the longitudinal axis of the strip 170 and the longitudinal axis of the shell 180. The wall 178 cooperates with the strip 170 to define a hole or opening 179 having a semi-circular cross-section. A resulting advantage of this embodiment 160 is that the distal ends of a shoe lace may be inserted through the opening 179 and then tied into a knot to more securely connect the strip 160 to the shoe.

The shell 180 is adapted to releasably connect a figurine to the device 160. The shell 180 is defined between an outer cylindrical sidewall 181 and an inner cylindrical sidewall 182. The inner cylindrical sidewall 182 cooperates with the strip 170 to define an upwardly opening cylindrical compartment 189. A figurine may be releasably connected to the device 160 by inserting a portion thereof into the compartment 189 and/or over the outer sidewall 181. The shell 180 is oriented and positioned relative to the strip 170 to support the figurine in a generally upright position over the toe of the shoe.

A fourth embodiment of the present invention is designated as 160' in FIGS. 7–8. Like the preceding embodiment 160, the device 160' includes an elongate strip 170' extending from a first end 171 to a second end 172; a semi-cylindrical sidewall 178' connected to the strip 170'; and a cylindrical shell 180 extending perpendicularly away from the strip 170 proximate the second end 172. Unlike the preceding embodiment 160, the sidewall 178' and the resulting compartment 179' on the device 160' are nearer the second end 172 of the strip 170' and thus, positioned to receive an intermediate portion of a shoe lace. A resulting advantage of this embodiment 160' is that the strip 170' remains secured to the shoe even when the laces come untied.

A fifth embodiment of the present invention is designated as 200 in FIGS. 9–10. Like the first embodiment 100, the device 200 includes an elongate base or strip 210 extending from a first end 211 to a second end 212; and a cylindrical shell 220 extending perpendicularly away from the strip 210 proximate the second end 212. Like the other foregoing embodiments, the device 200 provides a discrete shoe connecting means 210.

The strip 210 is adapted to be releasably connected to a shoe and to generally parallel the tongue of the shoe. Among other things, the strip 210 is about five mils thick, made of flexible plastic, and sized and configured to fit within the laces of a shoe. Unlike the first embodiment 100, the device 200 has inverted L-shaped members or hooks 218 and 219 connected to the strip 210. The hooks 218 and 219 and the shell 220 are disposed on the same side of the strip 210, and the hooks 218 and 219 extend away from the strip 210 and then away from one another. A resulting advantage of this embodiment 200 is that the strip 210 may be inserted into relatively secure engagement with the laces without loosening or otherwise disrupting the laces. In particular, the hooks 218 and 219 may be inserted between laces in such a manner that a relatively rearward lace discourages the hook 218 from moving rearward, and a relatively forward lace discourages the hook 219 from moving forward.

The shell 220 is adapted to releasably connect a figurine to the device 200. The shell 220 is defined between an outer cylindrical sidewall 221 and an inner cylindrical sidewall 222. The inner cylindrical sidewall 222 cooperates with the strip 210 to define an upwardly opening cylindrical compartment 229. A figurine may be releasably connected to the device 200 by inserting the figurine into the compartment 229 and/or over the outer sidewall 221. The shell 220 is oriented and positioned relative to the strip 210 to support the figurine in a generally upright position over the toe of the shoe.

A sixth embodiment of the present invention is designated as 230 in FIGS. 11–12. Like the first embodiment 100, the device 230 includes an elongate strip 240 extending between a first end 241 and a second end 242; and a cylindrical shell 250 extending perpendicularly away from the strip 240 near the second end 242.

The strip or base 240 is adapted to be releasably connected to a shoe and to generally parallel the tongue of the shoe. Among other things, the strip 240 is about five mils thick, made of flexible plastic, and sized and configured to fit within the laces of a shoe. Unlike the first embodiment 100, the strip 240 on this device 230 is contoured to be interwoven with the laces of a shoe. A resulting advantage of this embodiment 230 is that the strip 240 may be inserted into relatively secure engagement with the laces without loosening or otherwise disrupting the laces. In particular, the strip 240 is configured to underlie every other set of laces, and the upwardly convex portions of the-strip 240 tend to resist being pulled beneath these laces.

The shell 250 is adapted to releasably connect a figurine to the device 230. The shell 250 is defined between an outer cylindrical sidewall 251 and an inner cylindrical sidewall 252. The inner cylindrical sidewall 252 cooperates with the strip 240 to define an upwardly opening cylindrical compartment 259. A figurine may be releasably connected to the device 230 by inserting a portion thereof into the compartment 259 and/or over the outer sidewall 251. The shell 250 is oriented and positioned relative to the strip 240 to support the figurine in a generally upright position over the toe of the shoe.

Figure 14:
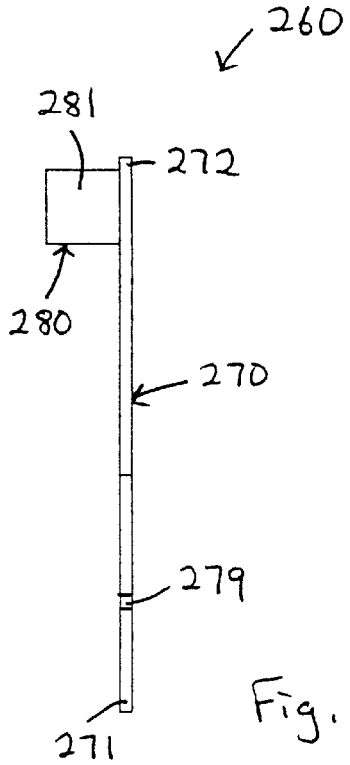
FIG. 14 is a side view of the device of FIG. 13.

A seventh embodiment of the present invention is designated as 260 in FIGS. 13–14. Though not identical in size or shape to the first embodiment 100, the device 260 similarly includes a thin member or base 270 extending from a first end 271 to a second end 272; and a cylindrical shell 280 extending perpendicularly away from the base 270 proximate the second end 272. Also like the foregoing embodiments, the base 270 provides a means for connecting the device 260 to a shoe, and the shell 280 provides a means for connecting a figurine to the device 260.

The base 270 is adapted to be releasably connected to a shoe proximate the juncture between the tongue and the toe portion of the shoe. Among other things, the base 270 is about five mils thick, made of plastic, and sized and configured to fit within the laces of a shoe. Like the second embodiment 130, the device 260 has two slots or openings 279 extending through the base 270 proximate the first end 271. Unlike the second embodiment 130, however, the slots 279 are generally T-shaped, extending laterally inward from opposite edges 273 of the base 270 and then both forward and rearward. A resulting advantage of this embodiment 260 is that the base 270 may be inserted into relatively secure engagement with the laces without loosening or otherwise disrupting the laces. In particular; intermediate portions of the laces may be inserted directly into the lateral portions of the slots 279 and then reoriented in the longitudinal portions of the slots 279 so that they are not inclined to reenter the lateral portions.

The shell 280 is adapted to releasably connect a figurine to the device 260. The shell 280 is defined between an outer cylindrical sidewall 281 and an inner cylindrical sidewall 282. The inner cylindrical sidewall 282 cooperates with the base 270 to define an upwardly opening cylindrical compartment 289. A figurine may be releasably connected to the device 260 by inserting the figurine into the compartment 289 and/or over the outer sidewall 281. The shell 280 is oriented and positioned relative to the base 270 to support the figurine in a generally upright position over the toe of the shoe.

Figure 15:
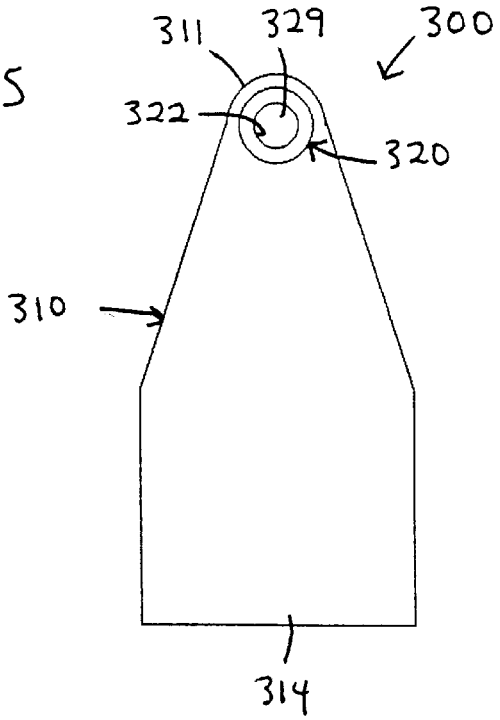
FIG. 15 is a top view of an eighth device constructed according to the principles of the present invention.
Figure 16:
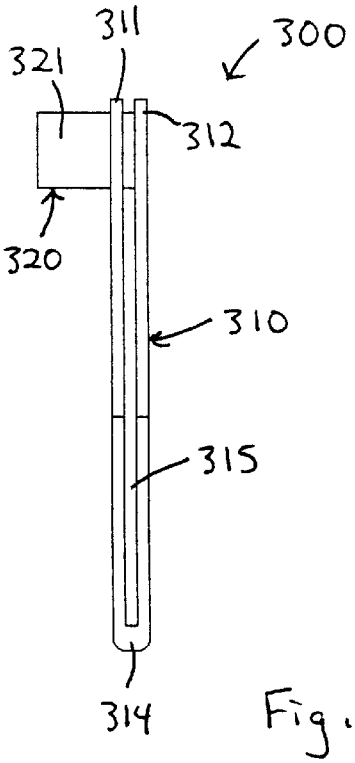
FIG. 16 is a side view of the device of FIG. 15.

An eighth embodiment of the present invention is designated as 300 in FIGS. 15–16. Like the previous embodiment 260, the device 300 includes a relatively less elongate base 310 extending from a first end or terminal portion 311 to a second end or terminal portion 312; and a cylindrical shell 320 extending perpendicularly away from the base 310 proximate the extreme second end 312.

The base 310 is adapted to be releasably connected to a shoe proximate the juncture between the tongue and the toe portion of the shoe. Among other things, the base 310 is made of resilient plastic about five mils thick, and is sized and configured to fit within the laces of a shoe. Unlike the base 270 of the previous embodiment 260, however, the base 310 has a generally U-shaped profile, and the terminal portions 311 and 312 of the base 310 overlie one another opposite a common end or juncture 314. The shell 320 extends away from the second end 312 of the base 310 and through a hole in the first end 311 of the base 310. In this manner, the base 310 and the shell 320 cooperate to define a closed loop about an interior space 315.

A resulting advantage of this embodiment 300 is that the base 310 may be secured to the laces without loosening or otherwise disrupting the laces. In particular, the ends 311 and 312 of the base 310 may be pulled apart from one another to allow access to the space 315; the portion terminating in end 312 may then be inserted beneath one or more laces; and then the shell 320 may be inserted back through the first end 311 to retain the one or more laces within the space 315.

The shell 320 is adapted to releasably connect a figurine to the device 300. The shell 320 is defined between an outer cylindrical sidewall 321 and an inner cylindrical sidewall 322. The inner cylindrical sidewall 322 cooperates with the base 310 to define an upwardly opening cylindrical compartment 329. A figurine may be releasably connected to the device 300 by inserting a portion thereof into the compartment 329 and/or over the outer sidewall 321. The shell 320 is oriented and positioned relative to the base 310 to support the figurine in a generally upright position over the toe of the shoe. The attachment of the figurine also tends to discourage the first end 311 from pulling away from the second end 312.

A ninth embodiment of the present invention is designated as 330 in FIGS. 17–18. Like the previous embodiment 300, the device 330 includes a relatively less elongate base 340 extending from a first end 341 to a second end 342; and a cylindrical shell 350 extending perpendicularly away from the base 340 proximate the second end 342. Also like the previous embodiment 300, the base 340 is generally U-shaped and selectively forms a closed loop about one or more laces of a shoe.

The base 340 is adapted to be releasably connected to a shoe proximate the juncture between the tongue and the toe portion of the shoe. Among other things, the base 340 is made of resilient plastic about five mils thick, and is sized and configured to fit within the laces of a shoe. Unlike the base 310 of the previous embodiment 300, however, the base 340 has a generally J-shaped profile, and the first end 311 lies beneath the main body 346, generally intermediate the second end 312 and a common end or juncture 314. A post 347 extends away from the first end 342 of the base 340 and through a hole in the main body 346 of the base 340 to define a closed loop about a space 345. A resulting advantage of this embodiment 330 is that the base 340 may be secured to the laces without loosening or otherwise disrupting the laces. In particular, the first end 341 of the base 340 may be pulled away from the main portion 346 to allow access to the space 345; the end 341 may then be inserted beneath one or more laces; and the post 347 may then be pushed back through the hole in the main portion 346 to retain the one or more laces within the space 345.

The shell 350 is adapted to releasably connect a figurine to the device 330. The shell 350 is defined between an outer cylindrical sidewall 351 and an inner cylindrical sidewall 352. The inner cylindrical sidewall 352 cooperates with the base 340 to define an upwardly opening cylindrical compartment 359. A figurine may be releasably connected to the device 330 by inserting the figurine into the compartment 359 and/or over the outer sidewall 351. The shell 350 is oriented and positioned relative to the base 340 to support the figurine in a generally upright-position over the toe of the shoe.

A tenth embodiment of the present invention is designated as 360 in FIGS. 19–20. Like the embodiment 260 described above, the device 360 includes a relatively less elongate base 370 extending from a first end 371 to a second end 372; and a cylindrical shell 380 extending perpendicularly away from the base 370 proximate the second end 372.

The base 370 is adapted to be releasably connected to a shoe proximate the juncture between the tongue and the toe portion thereof. Among other things, the base 370 is about five mils thick, made of plastic, and sized and configured to fit within the laces of a shoe. Unlike the embodiment 260 described above, the device 360 has slots 378 and 379 extending longitudinally inward from the edge bordering the first end 371 of the base 370. The outside slots 378 are linear in shape, and the inside slots 379 are generally T-shaped. A resulting advantage of this embodiment 360 is that the base 370 may be inserted into relatively secure engagement with the laces without loosening or otherwise disrupting the laces. In particular, intermediate portions of the laces may be interwoven through the slots 378 and 379 and/or inserted directly into the longitudinal portions of the slots 379 and then reoriented in the lateral portions of the slots 379 so that they are not inclined to reenter the longitudinal portions.

The shell 380 is adapted to releasably connect a figurine to the device 360. The shell 380 is defined between an outer cylindrical sidewall 381 and an inner cylindrical sidewall 382. The inner cylindrical sidewall 382 cooperates with the base 370 to define an upwardly opening cylindrical compartment 389. A figurine may be releasably connected to the device 360 by inserting the figurine into the compartment 389 and/or over the outer sidewall 381. The shell 380 is oriented and positioned relative to the base 370 to support the figurine in a generally upright position over the toe of the shoe.

An eleventh embodiment of the present invention is designated as 400 in FIGS. 21–23. Like the preceding embodiment 360, the device 400 includes a base 410 extending from a first end 411 to a second end 412; and a cylindrical shell 420 extending perpendicularly away from the base 410 proximate the second end 412. However, the base 410 may be described as more triangular in shape, as opposed to elongate.

The base 410 is adapted to be releasably connected to a shoe proximate the juncture between the tongue and the toe portion of the shoe. Among other things, the base 410 is about five mils thick, made of plastic, and sized and configured to fit between the lace supporting flaps on a shoe. The first end 411 of the base 410 is relatively wider than on the preceding embodiment 360, with tabs projecting laterally beyond each side of the base 410. Also, the device 400 has a generally T-shaped member 418 connected to the first end 411 of the base 410 in such a manner that opposite ends of the member 418 cooperate with the projecting tabs of the first end 411 to define notches or openings 419 which open away from one another. A resulting advantage of this embodiment 400 is that the base 410 may be inserted into relatively secure engagement with a shoe without loosening or otherwise disrupting the laces. In particular, the protruding tabs and ends of the base 410 and the member 418, respectively, may be inserted behind the junctures between the lace supporting flaps and the toe portion, and/or the lace supporting flaps on the shoe may be inserted into the outwardly opening notches 419 on the base 410 and held therein by friction.

The shell 420 is adapted to releasably connect a figurine to the device 400. The shell 420 is defined between an outer cylindrical sidewall 421 and an inner cylindrical sidewall 422. The inner cylindrical sidewall 422 cooperates with the base 410 to define an upwardly opening cylindrical compartment 429. A figurine may be releasably connected to the device 400 by inserting a portion thereof into the compartment 429 and/or over the outer sidewall 421. The shell 420 is oriented and positioned relative to the base 410 to support the figurine in a generally upright position over the toe of the shoe.

A twelfth embodiment of the present invention is designated as 430 in FIGS. 24–26. Like the preceding embodiment 400, the device 430 includes a generally triangular base or shoe connecting means 440 extending from a relatively wide first end 441 to a relatively narrow second end 442; and a cylindrical shell or connecting means 450 extending perpendicularly away from the base 440 proximate the second end 442.

The base 440 is adapted to be releasably connected to a shoe proximate the juncture between the tongue and the toe portion of the shoe. Among other things, the base 440 is about five mils thick, made of plastic, and sized and configured to fit beneath the lace supporting flaps on a shoe. The first end 441 of the base 440 is relatively wider than on the preceding embodiment 400, with downwardly curved tabs 448 projecting laterally beyond each side of the remainder of the base 440. A resulting advantage of this embodiment 430 is that the base 440 may be inserted into relatively secure engagement with a shoe without loosening or otherwise disrupting the laces. In particular, the protruding tabs 448 may be inserted behind the junctures between the lace supporting flaps and the toe portion and beneath the lace supporting flaps.

The shell 450 is adapted to releasably connect a figurine to the device 430. The shell 450 is defined between an outer cylindrical sidewall 451 and an inner cylindrical sidewall 452. The inner cylindrical sidewall 452 cooperates with the base 440 to define an upwardly opening cylindrical compartment 459. The figurine may be releasably connected to the device 430 by inserting a portion thereof into the compartment 459 and/or over the outer sidewall 451. The shell 450 is oriented and positioned relative to the base 440 to support the figurine in a generally upright position over the toe of the shoe.

A thirteenth embodiment of the present invention is designated as 460 in FIGS. 27–28. Though not identical in size or shape to any of the embodiments discussed above, the device 460 includes an elongate base or shoe connecting means 470 extending from a first end 471 to a second end 472; and a cylindrical shell or connecting means 480 extending perpendicularly away from the base 470 proximate the second end 472.

Among other things, the base 470 is about five mils thick, made of plastic, and sized and configured to fit beneath at least one closure on a shoe. Proximate the first end 471 of the base 470, hook type fasteners 478 are disposed on the same side of the base 470 as the shell 480, and loop type fasteners 477 are disposed on the opposite side of the base 470. A resulting advantage of this embodiment 460 is that the base 470 may be readily secured to a shoe of the type having hook and loop type closures. In particular, the downwardly facing, loop type fasteners 477 engage upwardly facing, hook type fasteners on a shoe closure, and the upwardly facing, hook type fasteners 478 engage downwardly facing, loop type fasteners on the shoe closure. Openings or slots 479, shown in dashed lines, may be provided to accommodate lace type closures, as well. In other words, the base 470 may be seen to provide both a means 479 for connecting the device 460 relative to a lace type shoe closure, and a means 477 and 478 for connecting the device 460 relative to a hook-and-loop type shoe closure.

Those skilled in the art will also recognize that features described with reference to particular embodiments may be mixed and matched according to specific design criteria and/or particular applications. For example, hook and loop type fasteners similar to those designated as 477 and 478 could be added to other embodiments to facilitate connection relative to the hook and loop type of shoe closure, as well as to laces.

The shell 480 is adapted to releasably connect a figurine to the device 460. The shell 480 is defined between an outer cylindrical sidewall 481 and an inner cylindrical sidewall 482. The inner cylindrical sidewall 482 cooperates with the base 470 to define an upwardly opening cylindrical compartment 489. A figurine may be releasably connected to the device 460 by inserting a portion thereof into the compartment 489 and/or over the outer sidewall 481. The shell 480 is oriented and positioned relative to the base 470 to support the figurine in a generally upright position over the toe of the shoe.

A fourteenth embodiment of the present invention is designated as 500 in FIGS. 29–30. Like the foregoing embodiment 400 discussed above, the device 500 includes a generally triangular base 510 extending from a first, relatively wide end 511 to a second, relatively narrow end 512; and a cylindrical shell 520 extending perpendicularly away from the base 510 proximate the second end 512.

The base 510 is adapted to be releasably connected to a shoe proximate the juncture between the tongue and the toe portion of the shoe. Among other things, the base 510 is about five mils thick, made of plastic, and sized and configured to fit beneath the lace supporting flaps on a shoe. The first end 511 of the base 510 is comparable in width to the embodiment 400 discussed above, with tabs 518 projecting laterally beyond each side of the remainder of the base 510. A post 519 extends perpendicularly away from each of the tabs 518 on the same side of the base 510 as the shell 520. A resulting advantage of this embodiment 430 is that the base 440 may be inserted into relatively secure engagement with a shoe without loosening or otherwise disrupting the laces. In particular, the protruding tabs 518 may be inserted behind the junctures between the lace supporting flaps and the toe portion and beneath the lace supporting flaps, and the posts 519 may be inserted into lace accommodating holes extending through the lace supporting flaps.

The shell 520 is adapted to releasably connect a figurine to the device 500. The shell 520 is defined between an outer cylindrical sidewall 521 and an inner cylindrical sidewall 522. The inner cylindrical sidewall 522 cooperates with the base 510 to define an upwardly opening cylindrical compartment 529. A figurine may be releasably connected to the device 500 by inserting the figurine into the compartment 529 and/or over the outer sidewall 521. The shell 520 is oriented and positioned relative to the base 510 to support the figurine in a generally upright position over the toe of the shoe.

Figure 31:
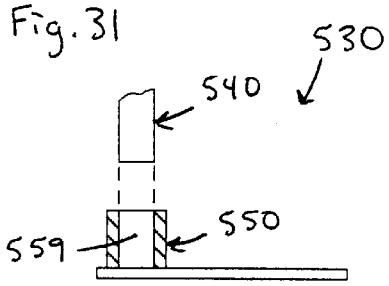
FIG. 31 is an exploded, partially sectioned side view of a first fastener combination constructed according to the principles of the present invention.

A first connecting means or fastener combination 530 is shown in FIG. 31. The combination 530 includes a shaft 540 connected to a figurine, and a shell 550 like those on all of the embodiments discussed above. The shaft 540 inserts into the compartment 559 bordered by the shell 550 and is retained therein by friction fit.

Figure 32:
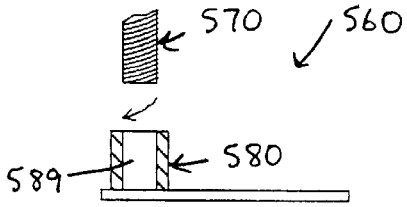
FIG. 32 is an exploded, partially sectioned side view of a second fastener combination constructed according to the principles of the present invention.

A second connecting means or fastener combination 560 is shown in FIG. 32. The combination 560 includes a threaded shaft 570 connected to a figurine, and a shell 580 like those on all of the embodiments discussed above. The shaft 570 is threaded into the compartment 589 bordered by the shell 550 and is retained therein by the threads on the shaft 570. Internal threads may be formed in the interior sidewall of the compartment 589, or the threads on the shaft 570 may simply cut into the interior sidewall as the former is threaded into the latter.

Figure 33:
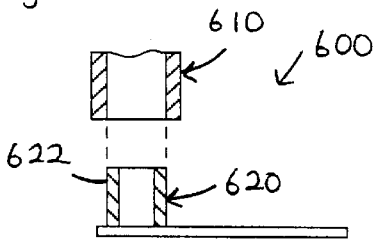
FIG. 33 is an exploded, partially sectioned side view of a third fastener combination constructed according to the principles of the present invention.

A third connecting means or fastener combination 600 is shown in FIG. 33. The combination 600 includes a tube 610 connected to a figurine, and a shell 620 like those on all of the embodiments discussed above. The tube 610 fits over the outer cylindrical sidewall 621 of the shell 550 and is retained thereon by friction fit.

Figure 34:
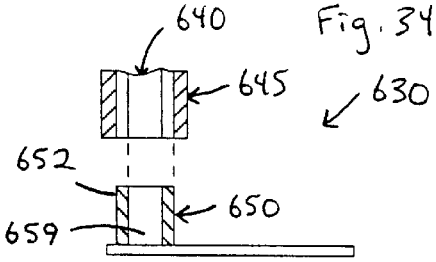
FIG. 34 is an exploded, partially sectioned side view of a fourth fastener combination constructed according to the principles of the present invention.

A fourth connecting means or fastener combination 630 is shown in FIG. 34. The combination 630 includes a shaft 640 and a tube 645 arranged coaxially and connected to a figurine, and a shell 650 like those on all of the embodiments discussed above. The shaft 640 inserts into the compartment 659 bordered by the shell 650 and is retained therein by friction fit, and the tube 645 fits over the outer cylindrical sidewall 651 of the shell 650 and is retained thereon by friction fit.

Figure 35:
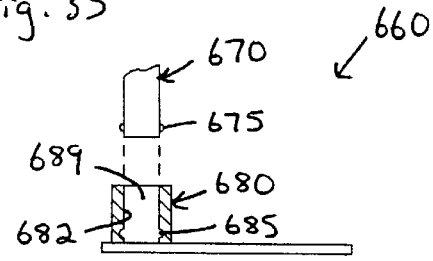
FIG. 35 is an exploded, partially sectioned side view of a fifth fastener combination constructed according to the principles of the present invention.

A fifth connecting means or fastener combination 660 is shown in FIG. 35. The combination 660 includes a shaft 670 connected to a figurine, and a shell 680 similar to those on all of the embodiments discussed above. A circumferential groove 685 is formed in the interior sidewall 682 of the shell 680 to receive ball detects 675 mounted on the shaft 670.

Figure 36:
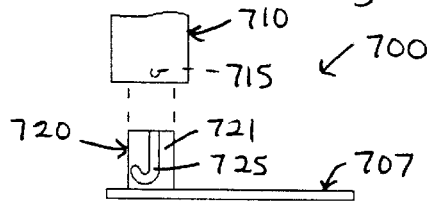
FIG. 36 is an exploded side view of a sixth fastener combination constructed according to the principles of the present invention.

A sixth connecting means or fastener combination 700 is shown in FIG. 36. The combination 700 includes a tube 710 connected to a figurine, and a post 720 extending upward from a base 707. The base 707 is adapted for mounting to a shoe in a manner similar to the embodiments discussed above. A generally J-shaped groove 725 is formed in the outer cylindrical sidewall 721 of the post 720 to receive a nub 715 which protrudes radially inward from the interior sidewall on the tube 710. The tube 710 fits over the outer cylindrical sidewall 721 of the shell 720 and is turned "over center" to force the nub 715 into the end of the groove 725 and thereby retain the figurine in place relative to the base 707.

A seventh connecting means or fastener combination 730 is shown in FIGS. 37–38. The combination 730 includes a base 740 having a first end (not shown) which is adapted for mounting to a shoe in a manner similar to the embodiments discussed above, and a second end or terminal portion 742 which is formed into a clip 745 relative to the remainder of the base 740. In particular, the second end 742 includes a pair of flanges 746 folded back against the remainder of the base 740, and a slot 747 disposed between the flanges 746. A post 750 extends from a first end which is connected to a figurine (not shown), to a second, opposite end 752 which is connected to an oversized head 755. The post 750 inserts into the slot 747, and the head 755 inserts between the flanges 746 and the base 740 and is effectively clamped or "clipped"therebetween.

An eighth connecting means or fastener combination 760 is shown in FIGS. 39–40. The combination 760 includes a base 770 having a first end (not shown) which is adapted for mounting to a shoe in a manner similar to the embodiments discussed above, and a second, opposite end 772. A pair of holes or openings 775 extend through the base 770 proximate the second end 772. A post 780 extends from a first end connected to a figurine (not shown), to a second, opposite end 782. A pair of hooks or latches 785 extend downward from the second end 782 and then away from one another. The latches 785 deflect toward one another to pass through the openings 775 and then deflect back away from one another to connect the post 780 to the base 770 by means of snap fit.

A ninth connecting means or fastener combination 800 is shown in FIG. 41. The combination 800 includes a base 810 having a first end (not shown) which is adapted for mounting to a shoe in a manner similar to the embodiments discussed above, and a second, opposite end 812. Hook type fasteners 815 are secured to the base 810 proximate the second end 812. With respect to the embodiment 460 shown in FIG. 27, the fasteners 815 could be provided in place of the connector 480 simply by extending the strip of fasteners 478. In any event, a post 820 extends from a.first end connected to a figurine (not shown), to a second, opposite end 822. Loop type fasteners 825: are secured to the second end 822 and selectively engage the hook type fasteners 815.

A tenth connecting means or fastener combination 830 is shown in FIG. 42. The combination 830 includes a shaft 840 connected to a figurine, and a shell 850 similar to the embodiments shown in FIGS. 31–35. A hole 855 extends radially through the shell 850. The shaft 840 inserts into the compartment 859 bordered by the shell 850 and is retained therein by a pin (not shown) extending through the hole 855 and an aligned hole 845 through the shaft 840.

Those skilled in the art will recognize that any of the foregoing fastener combinations may be used with any of the foregoing embodiments of the present invention, and further that many additional fastener combinations would be suitable for releasably connecting a figurine to a base member constructed according to the principles of the present invention.

Figure 43:
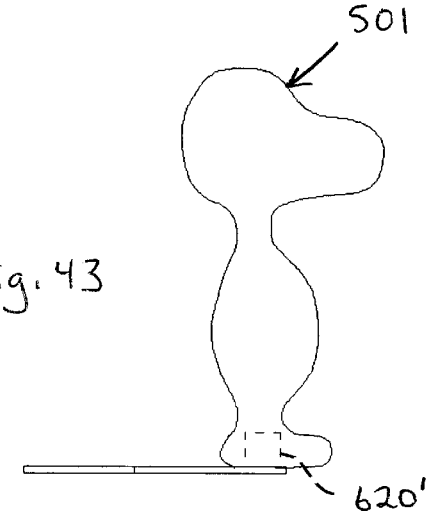
FIG. 43 is a side view of a first figurine, which is secured to a base in the manner shown in FIG. 31.

Recognizing that a stated objective of the present invention is to secure a figurine to a shoe, FIGS. 43–46 show a few examples of figurines suitable for use as part of the present invention. In FIG. 43, a figurine 501 is shown with a fastener combination (including a socket formed in the figurine and a connector 620') like that shown in FIG. 33. An advantage of this arrangement is that the figurine 501 is capable of freely standing on a flat surface when detached from the connector 620'. In this regard, the present invention may be seen to provide a means for using a figurine as an ornament for a shoe when not being used as a toy and/or a means for storing a toy on a shoe when the toy is not in use.

Figure 44:
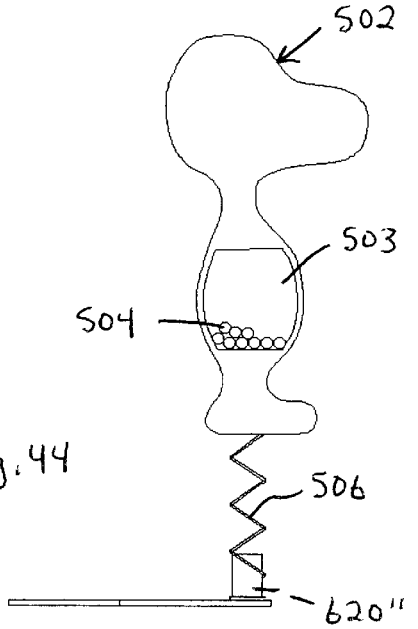
FIG. 44 is a partially sectioned side view of a second figurine, which is secured to a base in another manner.

In FIG. 44, a figurine 502 is shown with yet another fastener combination (including a post 620"). A spring 506 has a first end secured about the post 620" and a second end secured inside the figurine 502. A compartment 503 is provided inside the figurine 502 to retain noise making elements 504. As a result of this arrangement, the figurine 502 is capable of rocking relative to a person's shoe and/or making noise during movement of the person's shoe.

Figure 45:
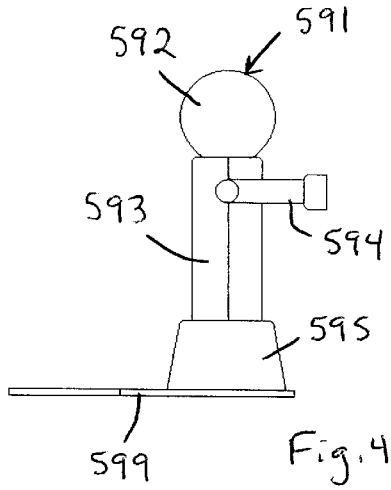
FIG. 45 is a side view of a third figurine, which is secured to a base in yet another manner.
Figure 46:
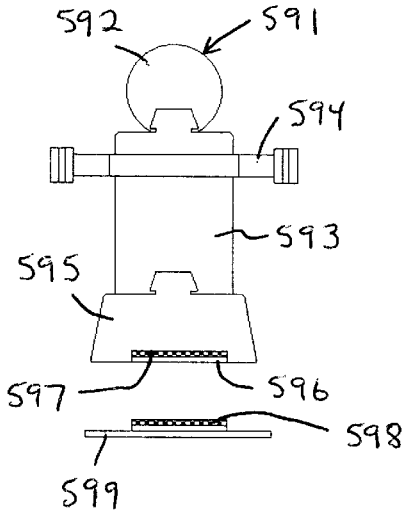
FIG. 46 is a partially sectioned front view of the figurine of FIG. 45.

FIGS. 45–46 show yet another figurine 591, which is connected to an elongate base member 599. The figurine 591 includes a spherical head member 592, a block-shaped torso member 593, an arm member 594, and a bottom member 595. The torso member 593 includes opposite front and back halves which are interconnected by a living hinge proximate the bottom member 595. The arm member 594 is rotatably retained between the opposite halves of the torso member 593 when an upwardly extending plug on the torso member 593 is inserted into an opening in the head member 592. A similar plug on the bottom member 595 inserts into an opening in the torso member 593 to rotatably mount the latter on the former. A recess 596 is formed in the bottom of the bottom member 595, and downwardly facing, hook type fasteners 597 are disposed therein. Upwardly facing, loop type fasteners 598 are mounted on top of a platform on the base 599. As a result of this arrangement, the figurine 591 is also capable of freely standing on a floor surface. Also, the appearance of the figurine 591 may be altered while it remains.mounted on a person's shoe.

A conventional shoe 90 is shown in FIGS. 47–48 in relation to the device 230 shown in FIGS. 11–12. The shoe 90 generally includes a toe portion 91, a heel portion 92, an intermediate portion 93 disposed therebetween, and an underlying sole 99. The intermediate portion 93 generally includes opposite flaps 94, closures or laces 95 interconnected between the flaps 94, and a tongue 96 underlying the laces 95 and the edges of the flaps 94. The toe portion 91, the flaps 94, and the tongue 96 are interconnected at a juncture 97 proximate the lace closest to the toe portion 91.

The device 230 is interwoven with the laces 95, with every other criss-crossing lacing extending beneath an upwardly convex portion of the strip 240, and the other lacing extending across the top of upwardly concave portions of the strip 240. The shell 250 provides a means for connecting a figurine to the base 240 in such a manner that the figurine extends generally upward from the toe portion 91 of the shoe 90. The other embodiments of the invention may be connected to various parts of the shoe 90 in accordance with their specific design to similarly provide a support above the toe portion 91 of the shoe 90.

Those skilled in the art will recognize that many conventional shoes, particularly shoes for children, have hook and loop type closures, rather than laces. The present invention is not necessarily limited to either type of closure, nor to any particular type of shoe, for that matter. In general, the present invention may be seen to provide a method of selectively modifying an existing shoe by releasably connecting a first portion of a member to a shoe so that a second portion of the member overlies a toe portion of the shoe; and securing a figurine to the second portion of the member so that the figurine appears to be standing on the toe portion of the shoe.

To further illustrate the wide applicability of the present invention, yet another embodiment is designated as 860 and shown relative to another conventional shoe 890 is shown in FIGS. 49–50. The shoe 890 generally includes a toe portion 891, a heel portion 892, an intermediate portion 893 disposed therebetween, and an underlying sole 899. The intermediate portion 893 generally includes opposite flaps 894, closures 895 interconnected between the flaps 894, and a tongue 896 underlying the closures 895 and the edges of the flaps 894. The toe portion 891, the flaps 894, and the tongue 896 are interconnected at a juncture proximate the closure nearest the toe portion 891. The closures 895 are straps which extend from one flap 894, through a loop or opening on an opposite flap 894, and back to the one flap 894. Overlapping portions of the straps are interconnected by means of hook and loop fasteners.

The device 860 includes a base 870 which extends from a first, relatively rearward end 871 to a second, relatively forward end 872. A figurine 880 is integrally connected to the second end 872 of the base 870 (during injection molding of the device 860, for example). Hook type fasteners 875 are secured to the upwardly facing side of the base 870 proximate the first end 871. The hook type fasteners interengage loop type fasteners facing downward from the upper portion of the closure strap. Loop type fasteners may alternatively or additional be secured to the downwardly facing side of the base 870 to interengage hook type fasteners facing upward from the lower portion of the closure strap.

A shoe constructed according to the principles of the present invention is designated as 900 in FIGS. 51–52. The shoe 900 generally includes a toe portion 901, a heel portion 902, an intermediate portion 903 disposed therebetween, and an underlying sole 909. The intermediate portion 903 generally includes opposite flaps 904, laces 905 interconnected between the flaps 904, and a tongue 906 underlying the laces 905 and the edges of the flaps 904. The toe portion 901, the flaps 904, and the tongue 906 are interconnected at a juncture 907 proximate the lace closest to the toe portion 901. An extension 919 of the sole material extends upward in front of and then backward across the toe portion 901 to form and/or support a cylindrical shell 920 similar to those on many of the embodiments, described above. In other words, a connector 920 is integrally connected to the shoe 900 to support a figurine in a generally upright orientation above the toe portion 901.

Another shoe constructed according to the principles of the present invention is designated as 950 in FIGS. 53–54. The shoe 950 generally includes a toe portion 951, a heel portion 952, an intermediate portion 953 disposed therebetween, and an underlying sole 959. The intermediate portion 953 generally includes opposite flaps 954, laces 955 interconnected between the flaps 954, and a tongue 956 underlying the laces 955 and the edges of the flaps 954. The toe portion 951, the flaps 954, and the tongue 956 are interconnected at a juncture 957 proximate the lace closest to the toe portion 951. An extension 969 of the sole material extends upward in front of and then backward across the toe portion 951 to form and/or support a figurine 980. In other words, a figurine 980 is integrally connected to the shoe 900 and extends generally upward from the toe portion 901.

Figure 55:
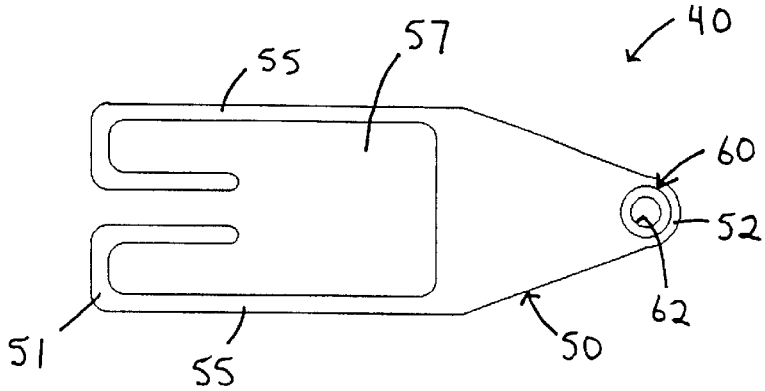
FIG. 55 is a top view of an eighteenth device constructed according to the principles of the present invention.
Figure 56:
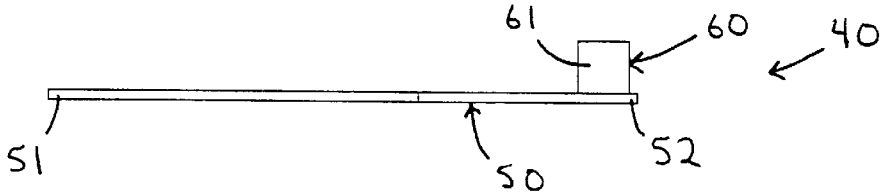
FIG. 56 is a side view of the device of FIG. 55.

Yet another embodiment of the present invention is designated as 40 in FIGS. 55–56. The device 40 includes a base or shoe connecting means 50 which extends from a first end 51 to a second end 52; and a cylindrical shell or figurine connecting means 60 which extends perpendicularly away from the base 50 proximate the second end 52.

Among other things, the base 50 is about five mils thick, made of flexible plastic, and sized and configured to fit beneath the closures of a shoe. In particular, the base 50 includes opposing J-shaped members 55 which extend away from the second end 52, then toward one another, and then toward the second end 52. The members 55 may be inserted rearward beneath one or more shoe laces, and the distal ends of the members 55 may pulled forward over at least one of the laces to secure the base 50 relative to the shoe. Alternatively, the members 55 may be positioned relatively rearward and above one or more shoe laces, and the distal ends of the members 55 may be inserted beneath at least one of the laces and pulled forward to secure the base 50 relative to the shoe. Additionally, the members 55 cooperate with the forward end or portion 52 of the base to define an opening 57 sufficient in size to allow connection of hook and loop type fasteners disposed above and below the base. In other words, the members 55 may be secured in place between a hook and loop type closure on a shoe.

The shell 60 is similar to those discussed above and thus, includes an outer cylindrical sidewall 61 and an inner cylindrical sidewall 62. Those skilled in the art will recognize that the shell 60 may be replaced by any of the other connecting means discussed above or by other types known in the art and suitable for the intended purpose. For example, a figurine may have a relatively thin, plate-shaped base with one or more holes extending through it, in which case, the connecting means may be one or more posts with oversized heads which insert through the holes and engage the base by snap fit.

Figure 57:
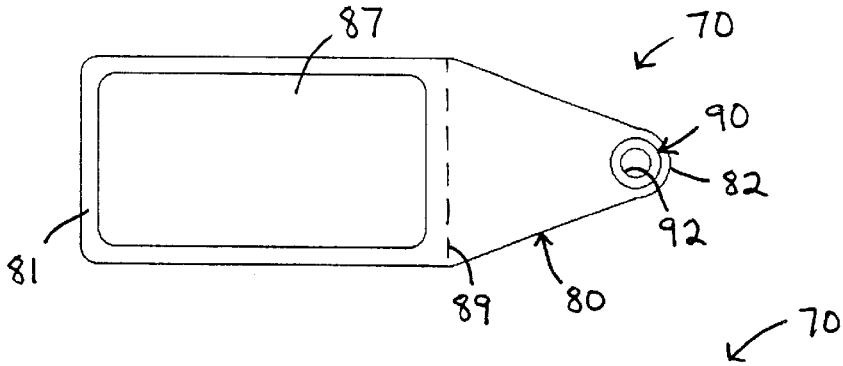
FIG. 57 is a top view of a nineteenth device constructed according to the principles of the present invention.
Figure 58:
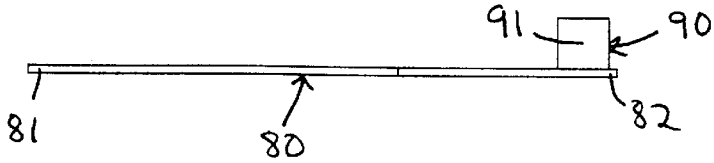
FIG. 58 is a side view of the device of FIG. 57.

Still another embodiment of the present invention is designated as 70 in FIGS. 57–58. Like the previous embodiment 40, the device 70 includes a base or shoe connecting means 80 which extends from a first end 81 to a second end 82; and a cylindrical shell or figurine connecting means 90 which extends perpendicularly away from the base 80 proximate the second end 82.

Among other things, the base 80 is about five mils thick, made of flexible plastic, and sized and configured to fit beneath the closures of a shoe. A relatively large opening 87 extends through the base 50. One or more lace type closures may be threaded through the opening in order to secure the base 50 relative to a shoe. Alternatively, one or more hook and loop type closures may be interconnected through the opening in order to secure the base 50 relative to a shoe. In other words, the base 80 provides a means for connecting the device 70 to a shoe having lace type closures, and the base 80 provides a means for connecting the device 70 to a shoe having hook and loop type closures. A living hinge 89 may be provided on the base 80 (or the base of any other embodiment) to encourage flexibility between the shoe connecting portion of the base 80 and the figurine supporting portion of the base 80.

The shell 90, having an outer sidewall 91 and an inner sidewall 92, is shown on the device 70. However, those skilled in the art will recognize that the present invention is not limited to this particular type of means for connecting a figurine to the base 80. Indeed, for reasons of practicality, the foregoing description and accompanying figures are necessarily limited to only some of the possible applications and embodiments to be constructed in accordance with the principles of the present invention.

The foregoing description will lead those skilled in the art to recognize additional configurations, embodiments, and/or applications which nonetheless incorporate the essence of the present invention. For example, a C-shaped base may be provided to clip about the toe portion of a shoe and provide support for an upwardly extending figurine. Moreover, those skilled in the art may be inclined to use aspects of the present invention to secure other amusing objects and/or ornaments to shoes. In view of the many possibilities, the scope of the present invention is to be limited only to the extent of the following claims.

What is claimed is:

1. An accessory in combination with a shoe of the type having a toe portion, a heel portion, and a transversely extending closure disposed therebetween, comprising:

a figurine having a head member, a bottom member, and a torso member disposed therebetween; and a means for securing the figurine to the closure on the shoe in a manner that holds the figurine in an erect display position on top of the toe portion of the shoe with the bottom member proximate the toe portion and the figurine extending upward from the toe portion to the head member, thereby creating the impression that the figurine is standing on the toe portion.

2. The accessory of claim 1, wherein the means includes a strip having a first portion disposed beneath the closure on the shoe, and a second portion disposed on top of the toe portion of the shoe.

3. The accessory of claim 2, wherein the figurine is releasably mounted on the second portion of the strip.

4. The accessory of claim 3, wherein a post is mounted on the strip, and the post is sized and configured for insertion into a hole in the figurine.

5. The accessory of claim 1, wherein the means is configured for alternative connection to a hook-and-loop type shoe closure and a lace type shoe closure.

6. The accessory of claim 1, wherein the bottom member is movably connected to the torso member.

7. An accessory in combination with a shoe of the type having a toe portion, a heel portion, and a transversely extending closure disposed therebetween, comprising:

an amusing object; and an elongate strip extending lengthwise beneath the closure on the shoe and forward onto the toe portion of the shoe, wherein the amusing object is releasably mounted on the strip in a display position forward of the closure and above the toe portion of the shoe.

8. The accessory of claim 7, wherein a post is mounted on the strip, and the post is sized and configured for insertion into a hole in the amusing object.

9. The accessory of claim 7, wherein the amusing object is a figurine that has legs and is configured and arranged to stand erect on the strip.

10. An accessory in combination with a shoe of the type having a toe portion, a heel portion, and a transversely extending closure disposed therebetween, comprising:

an amusing object; and an elongate strip, wherein the strip is configured and arranged to extend beneath both a first segment of the closure on the shoe, and a longitudinally spaced apart, second segment of the closure on the shoe, and forward onto the toe portion of the shoe, wherein the amusing object is secured to the strip in a display position forward of the closure and above the toe portion of the shoe.

11. An accessory in combination with a shoe of the type having a toe portion, a heel portion, and a transversely extending closure disposed therebetween, comprising:

a figurine;

a base having a first portion that is disposed beneath the closure on the shoe, and a second portion that is accessible from above; and a means for releasably securing the figurine to the second portion of the base, wherein the means includes a post on the base that is sized and configured for insertion into a hole in the figurine.

12. The accessory of claim 11, wherein the shoe is selected from the group consisting of a first type of shoe, having a lace type of closure, and a second type of shoe, having a hook-and-loop type of closure, and the first portion of the base is configured for connection to each said type of closure without interfering with operation of the closure.

13. The accessory of claim 11, wherein the figurine is a toy having a bodily shape that physically resembles a fictitious character.

14. An accessory in combination with a shoe of the type having a toe portion, a heel portion, and a transversely extending closure disposed therebetween, comprising:

a figurine;

a base having a first portion that is disposed beneath the closure on the shoe, and a second portion that is accessible from above, wherein the closure on the shoe includes a first segment disposed at a first distance from the toe portion of the shoe, and a second segment disposed at a relatively shorter, second distance from the toe portion of the shoe, and the base is configured and arranged to extend beneath both the first segment and the second segment; and a means for releasably securing the figurine to the second portion of the base.

15. An accessory in combination with a shoe of the type having a toe portion, a heel portion, and a transversely extending closure disposed therebetween, comprising:

a figurine; and a base having a first portion disposed beneath the closure on the shoe, and a second portion that defines an upwardly facing surface disposed above the toe portion of the shoe, wherein the figurine is mounted on the upwardly facing surface and is visible from above.

16. The accessory of claim 15, wherein the figurine is mounted in an upright position on top of the upwardly facing surface.

17. The accessory of claim 15, further comprising a means for releasably mounting the figurine on the second portion of the base.

18. The accessory of claim 15, wherein the figurine is a toy that is configured to resemble a fictitious character's bodily form.

19. The accessory of claim 15, wherein the closure on the shoe includes a first segment disposed at a first distance from the toe portion of the shoe, and a second segment disposed at a relatively shorter, second distance from the toe portion of the shoe, and the first portion of the base is configured and arranged to extend beneath both the first segment and the second segment.

20. An accessory in combination with a shoe of the type having a toe portion sized and configured to accommodate a person's toes, a heel portion sized and configured to accommodate a person's heel, and an intermediate portion disposed therebetween, comprising:

a base having opposing first and second members that define a gap therebetween, and a third member interconnected between the first and second members, wherein the first and second members are configured and arranged to clip onto the shoe in a manner that positions the third member on top of the toe portion of the shoe; and an amusing object mounted on the third member for display above the toe portion of the shoe.

21. The accessory of claim 20, wherein the first and second members are configured and arranged to straddle at least one closure on the shoe.

22. The accessory of claim 20, wherein the first and second members have respective first ends that are connected to discrete portions of the third member, and opposite, distal second ends.

23. The accessory of claim 22, wherein the second ends are configured and arranged to straddle at least one closure the shoe.

24. The accessory of claim 20, wherein the first and second members are flexible.

* * * * *